US008198955B2

(12) United States Patent
Reiche et al.

(10) Patent No.: US 8,198,955 B2
(45) Date of Patent: Jun. 12, 2012

(54) SIGNAL BRANCH FOR USE WITH CORRECTION INFORMATION IN A COMMUNICATION SYSTEM

(75) Inventors: Enrico Reiche, Glonn (DE); Richard Roberts, Bedfordshire (GB); Michael Schneider, Neubiberg (DE); Helmut Wolf, Holzkirchen (DE)

(73) Assignee: Astrium GmbH, Taufkirchen (DE)

( * ) Notice: Subject to any disclaimer, the term of this patent is extended or adjusted under 35 U.S.C. 154(b) by 208 days.

(21) Appl. No.: 12/549,981

(22) Filed: Aug. 28, 2009

(65) Prior Publication Data

US 2010/0052816 A1 Mar. 4, 2010

(30) Foreign Application Priority Data

Aug. 29, 2008 (DE) ..... 10 2008 044 895

(51) Int. Cl.
*H01P 5/12* (2006.01)

(52) U.S. Cl. ..... 333/125; 342/153

(58) Field of Classification Search ..... 333/125, 333/126, 135, 137, 21 A, 21 R; 343/756; 342/153

See application file for complete search history.

(56) References Cited

U.S. PATENT DOCUMENTS 3,566,309 A * 2/1971 Ajioka ..... 333/135
4,052,724 A * 10/1977 Takeichi et al. ..... 343/786
6,657,516 B1 12/2003 Junker et al.
6,714,165 B2 3/2004 Verstraeten
6,937,202 B2 8/2005 Chandler
2003/0222733 A1 12/2003 Ergene et al.

OTHER PUBLICATIONS

Jens Bornemann et al., "Modal Analysis and Design of the Dual-Band Orthomode Junction", Proc. ANTEM 2002, pp. 303-306, Montreal, Canada, Jul./Aug. 2002.

T. Yodokawa at al., "An X-Band Single Horn Autotrack Antenna Feed System", Antennas and Propagation Society International Symposium, vol. 19, pp. 86-89, Jun. 1981.

* cited by examiner

*Primary Examiner* — Benny Lee
(74) *Attorney, Agent, or Firm* — Crowell & Moring LLP

(57) ABSTRACT

A signal branch for use in a communication system, in particular in a reflector antenna, for the transmission of microwave signals is provided. The signal branch includes a common signal wave guide for transmitting a transmission signal and a received signal that has one first end and one second end as well as an exterior and interior. Moreover, a plurality of transmission signal wave guides is provided for feeding the transmission signal, with the transmission signal wave guides being disposed on the exterior of the common signal wave guide in a symmetrically distributed manner and each being communicatively connected to the common signal wave guide. A plurality of receiver signal wave guides is provided for transmitting the received signal, with the receiver signal wave guides being symmetrically adjacent to the second end of the common signal wave guide and each being communicatively connected to the common signal wave guide.

21 Claims, 5 Drawing Sheets

SIGNAL BRANCH FOR USE WITH CORRECTION INFORMATION IN A COMMUNICATION SYSTEM

CROSS REFERENCE TO RELATED APPLICATIONS

This application claims priority under 35 U.S.C. §119 to German Patent Application No. 10 2008 044895.8-55 filed Aug. 29, 2008, the entire disclosure of which is herein expressly incorporated by reference.

BACKGROUND OF THE INVENTION

The invention relates to a signal branch for use in a communication system, in particular a reflector antenna for transmitting microwave signals. The invention further relates to a method for processing a received signal fed into a signal branch.

Due to their very narrow beam characteristic, large reflector antennas require a very precise alignment relative to a transmitter and/or receiver, generally a remote station. A beacon signal emitted by the remote station is used for the alignment. In order to analyze the beacon signal by means of the reflector antenna, an alignment diagram is required with a zero point in the primary beam direction. If the beacon signal deviates from the primary beam direction, an additional signal is received that can be used to correct the directional deviation. The transmission, separation, and analysis of the beacon signal occurs in addition to the transmission of the actual communication signal. In so doing, the beacon signal may not influence the communication signal.

A reflector antenna for the transmission of microwave signals typically comprises a signal branch that has a common signal wave guide for transferring a transmission signal and a received signal. The common signal wave guide comprises one first and one second end as well as an exterior and an interior. A horn is connected to the first end of the common signal wave guide, by way of which the transmission signal departing the common signal wave guide is decoupled and the transmission signal in the common signal wave guide is coupled. As a rule, a plurality of signal wave guides is provided along with the common signal wave guide for feeding the transmission signal and for decoupling the received signal. The signal wave guides are, for example, disposed in a symmetrically distributed fashion on the exterior of the common signal wave guide and are each connected to the common signal wave guide in a communicative manner.

In particular, the signal branch has the task of processing a mode mixture of modes of the received signal in such a way that a differentiation occurs between the original communication signal and correction data for the communication signal. At the same time, the signal branch must correctly transfer a transmission signal fed into the plurality of signal wave guides to be decoupled by the horn. The ensuing conflict of objectives between correctly distributing the received signal with regard to its communication and correctly distributing the correction information and decoupling the transmission signal with the desired polarization from the reflector antenna has not always been satisfactorily resolved up to now.

The signal branch shown on page 54 of "Corrugated Horns for Microwave Antennas" by P. J. B. Clarricoates and A. D. Oliver has the disadvantage that separation of transmission and received signals is not possible, such that the signal branch is only suitable for receiver antennas.

U.S. Pat. No. 6,714,165 B2 discloses an orthomode transducer (orthomode transducer OMT) having a circular coaxial wave guide supply system. In this arrangement, the correction information necessary for correcting the communication signal, known as tracking modes, are not propagable in the reception path, so that the correction signal cannot be acquired.

The same problem is present in the signal branch disclosed in U.S. Pat. No. 6,657,516 B1. Here, the signal branch comprises a wave guide structure having one exterior and one interior wall, which form one exterior and one interior wave guide chamber. These chambers are connected in a communicative manner with the horn on one end of the signal branch. The exterior wall comprises one cylindrical section and one conical section, with the cylindrical section and the interior wall being oriented coaxially relative to one another. Moreover, symmetrically disposed signal wave guides are formed in one reception path around the cylindrical section, which are also coupled to the exterior chamber in a communicative fashion by means of impedance adapter blinds matching irises.

The publication "An X-band single horn autotrack antenna feed system" by Yodokawa, T. and Hamada, S. in Antennas and Propagation Society International Symposium, 1981, June 1981, vol. 19, pages 86-89, discloses a multi-mode coupler. This coupler uses the modes TE11 and TM01 to effect a correction of a circularly polarized communication signal. However, the method described by this publication allows the processing of only a "tracking" mode (TM01). The term "tracking" is to be understood as the processing of correction information in order to increase the precision of the communication signal. Moreover, the polarization effects directly degrade the orientation accuracy to be attained in orienting the reflector antenna as an error. Thus, the method described is not suitable for applications requiring high degrees of accuracy.

The antenna system described in the publication "Modal analysis and design of the dual-band orthomode junction" by J. Bornemann and J. Uher, Proc. ANTEM 2002, pages 303-306, Montreal, Canada, July/August 2002, has the disadvantage that the required tracking modes are not propagable in the reception path. Thus, it is not possible to acquire a correction signal. For this reason, the method described there is not suitable for a tracking application.

SUMMARY OF THE INVENTION

The object of the present invention is therefore to provide a signal branch for use in a communication system, particularly a reflector antenna, for the transmission of microwave signals that allows an improved correction of the directional deviation of the reflector antenna. The further object of the present invention is to provide a method for processing a received signal fed into a signal branch that allows improved precision for correcting the directional deviation.

These and other objects are attained by a signal branch in a communication system, particularly a reflector antenna, for the transmission of microwave signals, as well as a method for processing a received signal fed into the signal branch, in accordance with the present invention.

The invention proposes a signal branch for use in a communication system, particularly a reflector antenna, for transmitting microwave signals. This signal branch comprises a common signal wave guide for transmitting a transmission signal and a received signal having one first end and one second end as well as an exterior and an interior; the common signal wave guide is also referred to as a "common gate." The signal branch additionally comprises a plurality of transmission signal wave guides for feeding the transmission signal, with the transmission signal wave guides being disposed in a symmetrically distributed manner on the exterior of the common signal wave guide and each being connected in a communicative manner to the common signal wave guide. The transmission signal wave guides are also referred to as a "transmission gate." In addition, a plurality of receiver signal wave guides is provided for transmitting the received signal, with the receiver signal wave guides being symmetrically adjacent to the second end of the common signal wave guide and each being connected to the common signal wave guide in a communicative manner. The plurality of receiver signal wave guides is also referred to as a "receiver gate."

The signal branch according to the invention may be used in a reflector antenna used for transmitting and receiving purposes. In so doing, the signal branch allows the correction information necessary for correcting the communication signal to be generated from the received signal. In this manner, the signal branch according to the invention allows the directional deviation of the reflector antenna into which the signal branch has been integrated to be determined with a high degree of precision. This is made possible by virtue of the fact that the transmission signal and received signal are separated.

In particular, the common signal wave guide and the reception signal wave guide form a receiving path, which blocks a transmission signal that is fed into the transmission signal wave guide and which allows the propagation of a base mode with a communication signal (TE11) and two higher modes (TM01, TE21) with correction information for the communication signal if a received signal is fed into the common signal wave guide. The two higher modes (TM01, TE21) are also referred to as "tracking modes." The correction information is also referred to as "tracking information."

Moreover, the processing unit is designed for the purpose of generating cumulative signals and differential signals while processing the correction information (tracking) and to provide these signals under the same conditions, particularly at the same temperature. This embodiment allows a phase error due to different temperatures in the high frequency paths to be prevented.

A refinement of the invention proposes that the processing unit should be designed to provide the cumulative and differential signals only after the separation of the transmission and received signals. In this manner, disruptions of the transmission signal by a tracking mode coupler are prevented.

According to another embodiment, any polarization may be set by selecting the amplitudes and phases of the transmission signal fed into the transmission signal wave guide on the common signal wave guide. In particular, a polarization may be achieved that is vertical, horizontal, rotating in a circular fashion to the left and right, or rotating in an elliptical fashion to the left and the right.

For the improved decoupling of the transmission path from the reception path, a filter is provided in each of the transmission signal wave guides.

In another embodiment, a cone is provided for guiding the signal in the common signal wave guide on the second end and extending in the direction of the first end. This cone serves to "redirect" the transmission signal fed into the transmission signal wave guide, such that it is able to propagate in the common signal wave guide in the direction of the horn disposed on the first end of the signal wave guide.

The common signal wave guide may be embodied as a round wave guide or as a rectangular wave guide, particular as a square wave guide. In one concrete embodiment, the transmission signal wave guides have a rectangular cross section with one long and one short side edge. Here, in a first variant, the long side edges of each transmission signal wave guide may extend parallel to an axial direction of the common signal wave guide. In a second variant, the short side edges of each transmission signal wave guide may extend parallel to the axial direction of the common signal wave guide. In contrast, the receiver signal wave guides extend in the axial direction of the common signal wave guide.

The dimensions of the receiver signal wave guide are determined such that no modes may be propagated in the receiver signal wave guides at the transmission frequencies of the transmission signal. This measure provides the high degree of precision in the correction of the directional deviation of the reflector antenna discussed at the outset.

According to another embodiment, the signal branch is designed such that the received signal fed into the common signal wave guide is evenly distributed over the receiver signal wave guides. This means that the communication signal and the two modes are evenly distributed over the receiver wave guides. Here, the amplitudes in the receiver wave guides are equal; however, each mode has its specific phase pattern.

An additional embodiment provides for the signal branch to be coupled to a network of 90° and 180° hybrid couplers for breaking down and/or recombining a mode mixture of the modes of the received signal. On the one hand, the communication signal is separated from the tracking signals in this manner. On the other hand, a tracking signal is generated that receives the information regarding the value and direction of the alignment deviation.

In a concrete embodiment, the signal branch represents a turnstile branch.

The invention also creates a method for processing a received signal fed into a signal branch embodied according to the description above in which the received signal is divided into a base mode with a communication signal (TE11) and two higher modes (TM01, TE21) with correction information for the communication signal.

The method according to the invention has the same advantages as are described above in conjunction with the signal branch according to the invention.

In a refinement of the method according to the invention, two independent differential signals are provided by the processing of the correction information, whereby the tracking method for any polarization may be performed.

An additional embodiment provides for cumulative and differential signals to be generated during the processing of the correction information and for these signals to be provided under the same conditions, in particular at the same temperature. As explained above, this may prevent phase errors caused by different temperatures in the high frequency paths.

The invention further proposes that the cumulative and differential signals not be provided until after the separation of the transmission signal from the received signal.

According to an additional embodiment, by selecting the amplitudes and phases of the transmission signal fed into the transmission signal wave guides, a desired polarization is set at the common signal wave guide, in particular one that is that is vertical, horizontal, rotating in a circular fashion to the left and right, or rotating in an elliptical fashion to the left and the right.

Other objects, advantages and novel features of the present invention will become apparent from the following detailed description of one or more preferred embodiments when considered in conjunction with the accompanying drawings.

BRIEF DESCRIPTION OF THE DRAWINGS

The invention shall be described in greater detail in the following with reference to the exemplary embodiments shown in the drawings. Shown are.

DETAILED DESCRIPTION OF THE DRAWINGS

Figure 1:
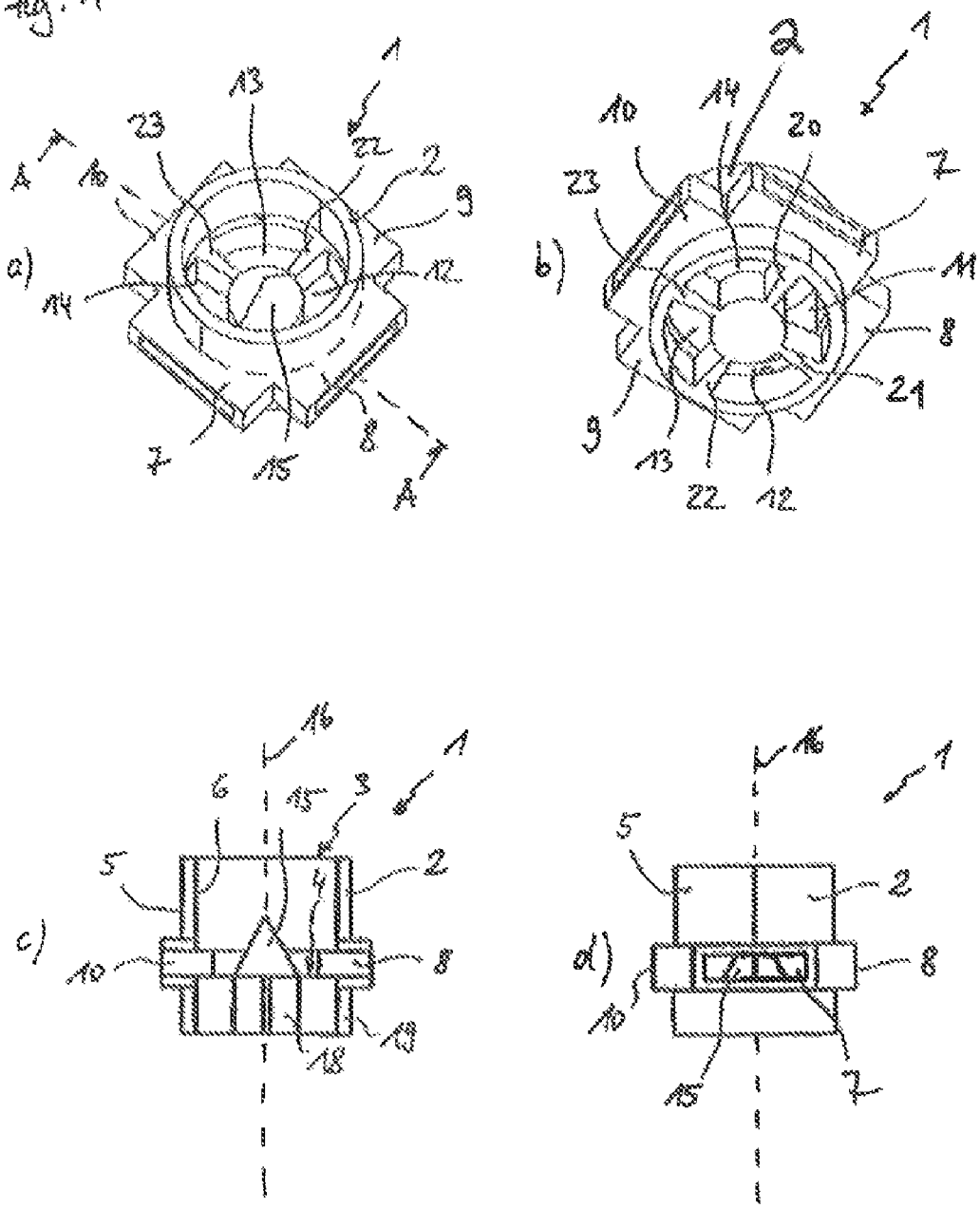
FIGS. 1*a* to 1*d* illustrate a first exemplary embodiment of a signal branch according to the invention in two perspective depictions from above and below, in a cross section, and in a side view.
Figure 2:
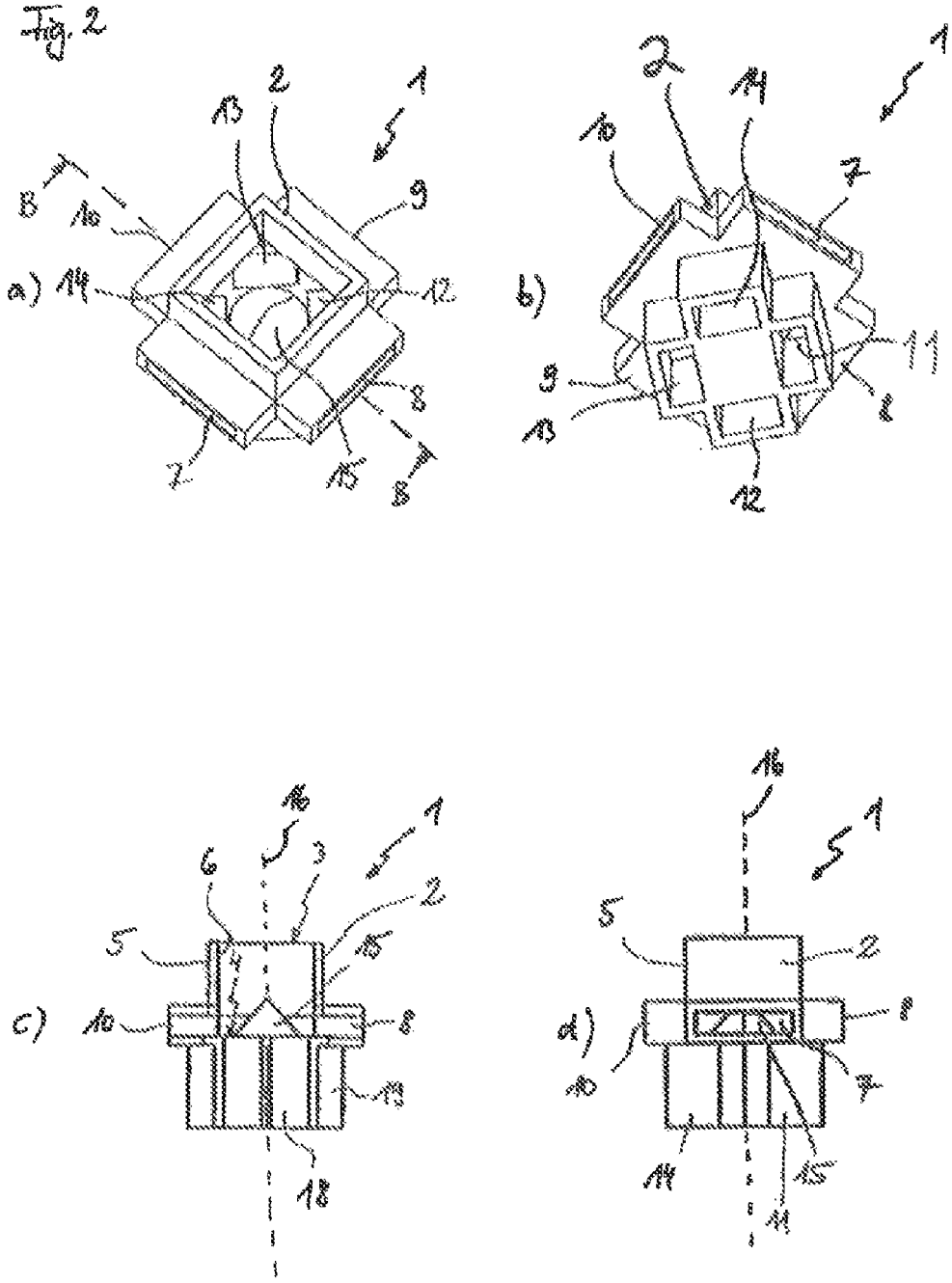
FIGS. 2*a* to 2*d* illustrate a second exemplary embodiment of a signal branch according to the invention in two perspective depictions from above and below, in a cross section, and in a side view.
Figure 3:
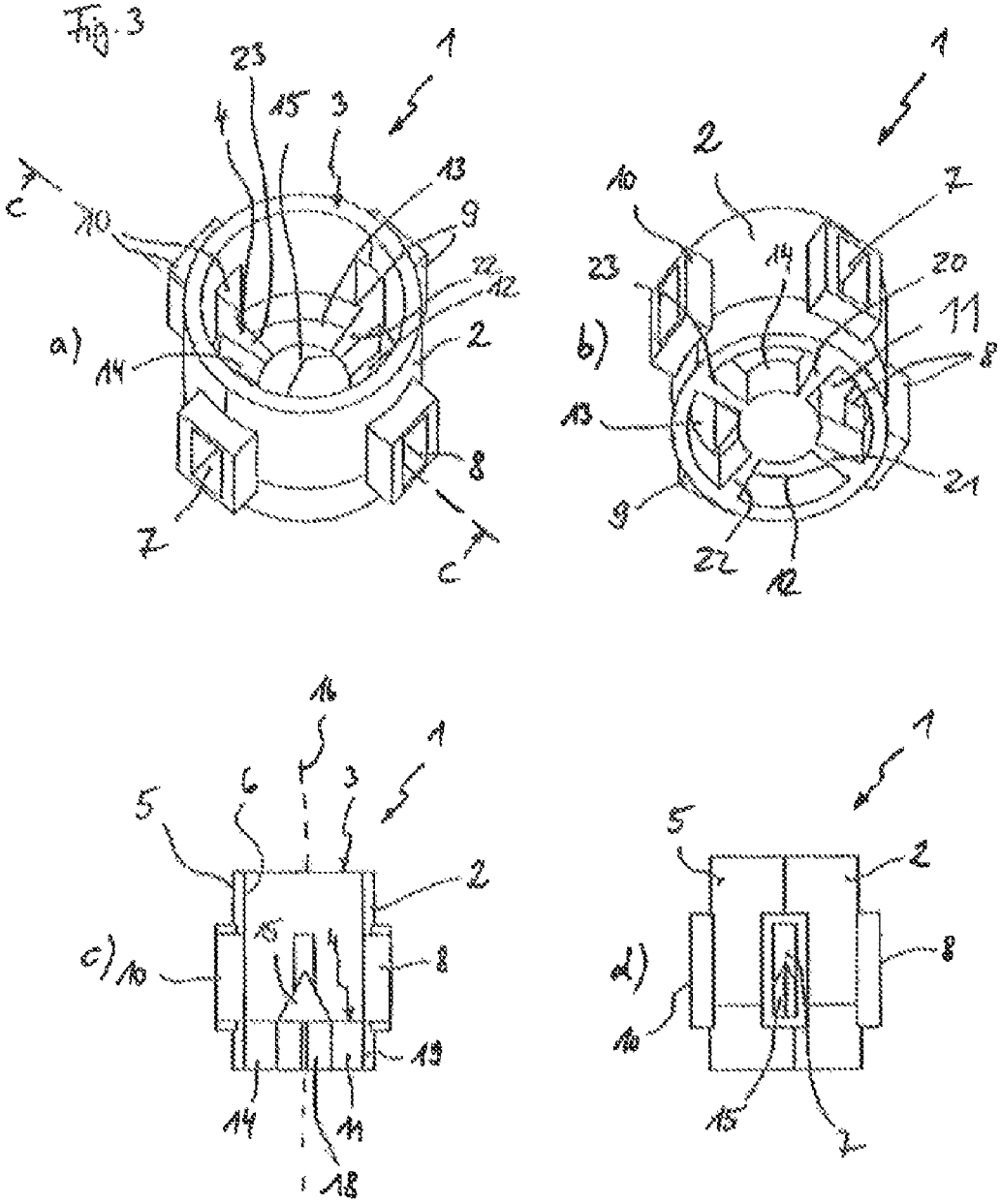
FIGS. 3*a* to 3*d* illustrate a third exemplary embodiment of a signal branch according to the invention in two perspective depictions from above and below, in a cross section, and in a side view.

FIGS. 1 to 3 show different exemplary embodiments of a signal branch 1 according to the invention. FIGS. 1*a*, 2*a*, and 3*a* each show a perspective view from the front, i.e., with a view of the common signal wave guide 2. FIGS. 1*b*, 2*b*, and 3*b* show a perspective view from behind, i.e., with a view of a plurality of receiver signal wave guides 11, 12, 13, 14. FIGS. 1*c*, 2*c*, and 3*c* each show a sectional view along the lines A-A, B-B, and C-C. Finally, FIGS. 1*d*, 2*d*, and 3*d* show a side view of the respective signal branch 1. Like features in the different drawing figures are designated by the same reference numbers and may not be described in detail in all drawing figures in which they appear.

The signal branch 1 according to the invention for use in a communication system, particularly for use in a reflector antenna, for the transmission of microwave signals comprises a common signal wave guide 2 for transmitting a transmission signal and a received signal. The common signal wave guide 2 comprises a first end 3 (FIGS. 1*c*, 2*c*, 3*a* and 3*c*) and a second end 4 (FIGS. 1*c*, 2*c*, 3*a* and 3*c*) as well as an exterior and an interior 5, 6 (FIGS. 1*c*, 2*c* and 3*c*). A horn of the reflector antenna, which is not shown in the drawings, is disposed on the first end 3. A plurality of transmission signal wave guides 7, 8, 9, 10 for feeding the transmission signal is arranged in a symmetrically distributed fashion on the exterior 6 of the common signal wave guide 2 on the second end 4. The transmission signal wave guides 7, 8, 9, 10 are each connected to the common signal wave guide in a communicative fashion. A plurality of receiver signal wave guides 11, 12, 13, 14 (FIGS. 1*b*, 2*b* and 3*b*) is provided for transmitting the received signal. The receiver signal wave guides 11, 12, 13, 14 are symmetrically adjacent to the second end 4 of the signal wave guide 2 and are each connected in a communicative fashion to the common signal wave guide. The signal branch is also known under the term "turnstile branch." The common signal wave guide 2 is also referred to as the "common gate" of the turnstile branch. In a corresponding fashion, the plurality of transmission signal wave guides is referred to as a "transmission gate" and the plurality of receiver signal wave guides is referred to as a "receiver gate."

In the interior of the common signal wave guide 2, a cone 15 (FIGS. 1*c*, 2*c* and 3*c*) is provided that extends in the direction of the first end 3 and that serves to guide the signal, particularly the transmission signal fed into the transmission signal wave guides 7, 8, 9, 10. A base of the cone 15 lies in the plane of the second end 4 of the common signal wave guide 2 (cf. the cross-sectional depictions in FIGS. 1*c*, 2*c*, and 3*c*). A cylindrical section 18 (FIGS. 1*c*, 2*c* and 3*c*) extends from the second end 4 of the common signal wave guide 2, such that it lies in a plane with the circular wall 19 of the receiver gate. In the exemplary embodiments shown in FIGS. 1*c* and 3*c*, the cylindrical section 18 has a circular cross section. In the exemplary embodiment according to FIG. 2*c*, the cylindrical section 18 has a square cross section.

The common signal wave guide 2 (common gate) may selectively be embodied as a round wave guide (as in the exemplary embodiments shown in FIGS. 1 and 3) or as a rectangular wave guide (cf. the exemplary embodiment shown in FIG. 2). Different geometric shapes may also be used in the design of the transmission signal wave guides 7, 8, 9, 10 and/or the receiver signal wave guides 11, 12, 13, 14.

In the exemplary embodiment according to FIG. 1, the transmission signal wave guides are given a rectangular cross section. The transmission signal wave guides 7, 8, 9, 10 have one long and one short side edge, with the short side edges of each transmission signal wave guide extending parallel to the axial direction 16 (FIGS. 1*c*, 1*d*) of the common signal wave guide. In contrast, in the exemplary embodiment according to FIG. 3, the long side edges of each transmission signal wave guide 7, 8, 9, 10 are oriented parallel to the axial direction 16 (FIG. 1*c*) of the common signal wave guide 2.

The cross-sectional design of the receiver gate in the exemplary embodiments in FIGS. 1 and 3 corresponds to the cross-sectional design of the common signal wave guide: in both exemplary embodiments, the receiver gate has a circular design. Here, the exterior diameters of the receiver gate are approximately equal to the exterior diameter of the common signal wave guide. Correspondingly, the wall thicknesses of the common signal wave guide 2 and the receiver gates of the exemplary embodiments according to FIGS. 1 and 3 are approximately equal. This results in an arced design of the individual receiver signal wave guides 11, 12, 13, 14, which are separated from one another by respective bridges 20, 21, 22, 23. In contrast, as may be best seen in FIG. 2*b*, the receiver signal wave guides 11, 12, 13, 14 have a rectangular design in the second exemplary embodiment.

By means of the structural designs of the turnstile branch described in the three exemplary embodiments, a transmission signal and a received signal may be separated. Here, the receiver path formed by the common signal wave guide and the receiver signal wave guides 11, 12, 13, 14 is provided such that the frequency of the transmission signal is blocked. The dimensions of the receiver signal wave guide are determined such that no modes may be propagated in the receiver signal wave guides at the transmission frequencies of the transmission signal, which provides a high degree of precision in the correction of the directional deviation of the reflector antenna. However, the propagation of received frequencies as well as a base mode with communication signals (TE11) as well as two higher modes (TM01 and TE21) with the correcting or tracking information required for the correction of the communication signal is made possible. Two independent differential signals are provided for the tracking, i.e., for the processing of the correction information. This guarantees that the tracking method may be performed for any polarizations and alignment errors resulting from a depolarization in the atmosphere are prevented. The cumulative and differential signals required for the tracking are decoupled under the same conditions. Particularly, decoupling occurs at the same temperature. In this manner, phase errors caused by different temperature in the high frequency (HF) paths are prevented. The (tracking) signals are not decoupled until after a separation of the transmission and received signals has occurred. In this manner, disruptions of the transmission signal by the tracking mode coupler may be prevented.

In the transmission case, the transmission signal is fed via the four transmission signal wave guides 7, 8, 9, 10 disposed laterally on the common signal wave guide. By a suitable selection of the amplitudes and phases on these four transmission signal wave guides, any polarization, i.e., vertical, horizontal, rotating in a circular fashion to the left and right, or rotating in an elliptical fashion to the left and the right, may be generated. For the improved decoupling of the transmission path, comprising the common signal wave guide 2 and the transmission signal wave guides 7, 8, 9, 10, from the receiving path, filters (not shown in FIGS. 1-3) may be built into the lateral transmission signal wave guides 7, 8, 9, 10.

In the receiving case, the horn provided on the first end of the common signal wave guide 2 couples a mixture of the modes TE11 (communication) as well as TM01 and TE21 (tracking) into the common signal wave guide 2 of the turnstile branch. This mode mixture is routed within the turnstile branch to the receiver signal wave guides 11, 12, 13, 14 leading to the rear of the wave guide 2. The dimension of the back four receiver signal wave guides 11, 12, 13, 14 are selected such that no modes are propagable at the frequencies of the transmission signal. The communication signal in the received signal and the two tracking modes (TM01 and TE21) are distributed over the four receiver signal wave guides 11, 12, 13, 14. Here, the amplitudes in the four receiver signal wave guides are equal; however, each mode has its specific phase pattern.

Figure 5:
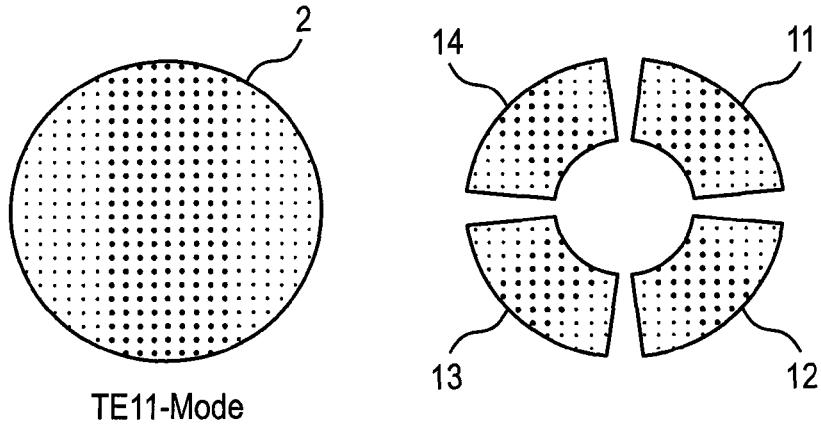
FIG. 5 illustrates the TE11 mode on a common gate and on a receiver gate of the signal branch.
Figure 6:
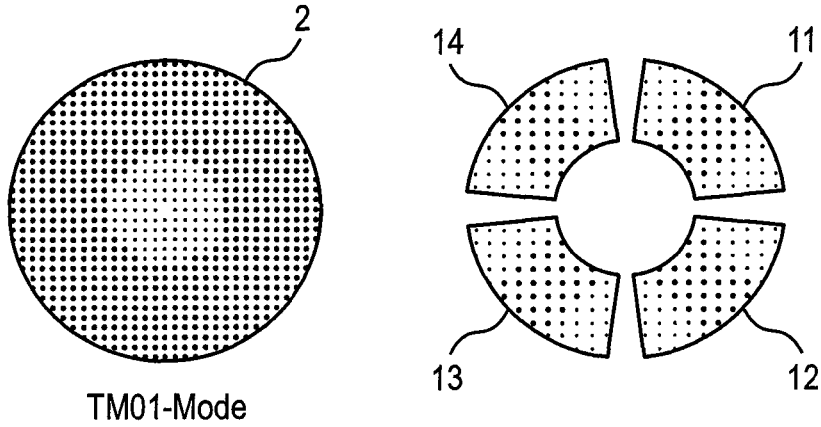
FIG. 6 illustrates the TM01 mode on the common gate and on the receiver gate of the signal branch.
Figure 7:
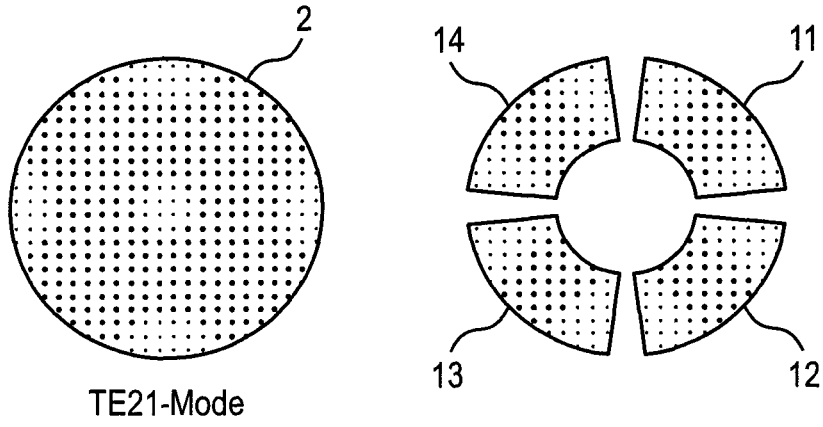
FIG. 7 illustrates the TE21 mode on the common gate and on the receiver gate of the signal branch.

This is shown by way of example in FIGS. 5 to 7. FIG. 5 shows the phase pattern for the TE11 mode. In the left-hand figure, the phase pattern at the common signal wave guide 2 is shown. In the right-hand figure, the phase pattern at the receiver signal wave guides 11, 12, 13, 14 is shown. FIG. 6 shows the phase pattern of the TM01 mode at the common signal wave guide 2 (left-hand figure) and at the receiver signal wave guides 11, 12, 13, 14 (right-hand figure). Correspondingly, FIG. 7 shows the specific phase pattern for the TE21 mode, with the phase pattern at the common signal wave guide 2 being shown in the left-hand figure and with the phase pattern at the receiver signal wave guides 11, 12, 13, 14 being shown in the right-hand figure.

Using the signal branch according to the invention, it is possible using a suitable network of 90° and 180° hybrid couplers (FIG. 4) to break the mode mixture down into individual modes and, optionally, to recombine them. On the one hand, the communication signal is separated from the tracking signals in this manner and, on the other hand, a tracking signal is generated that receives the information regarding the value and direction of the alignment deviation. Thus, a direct correction of the antenna alignment is possible.

Figure 4:
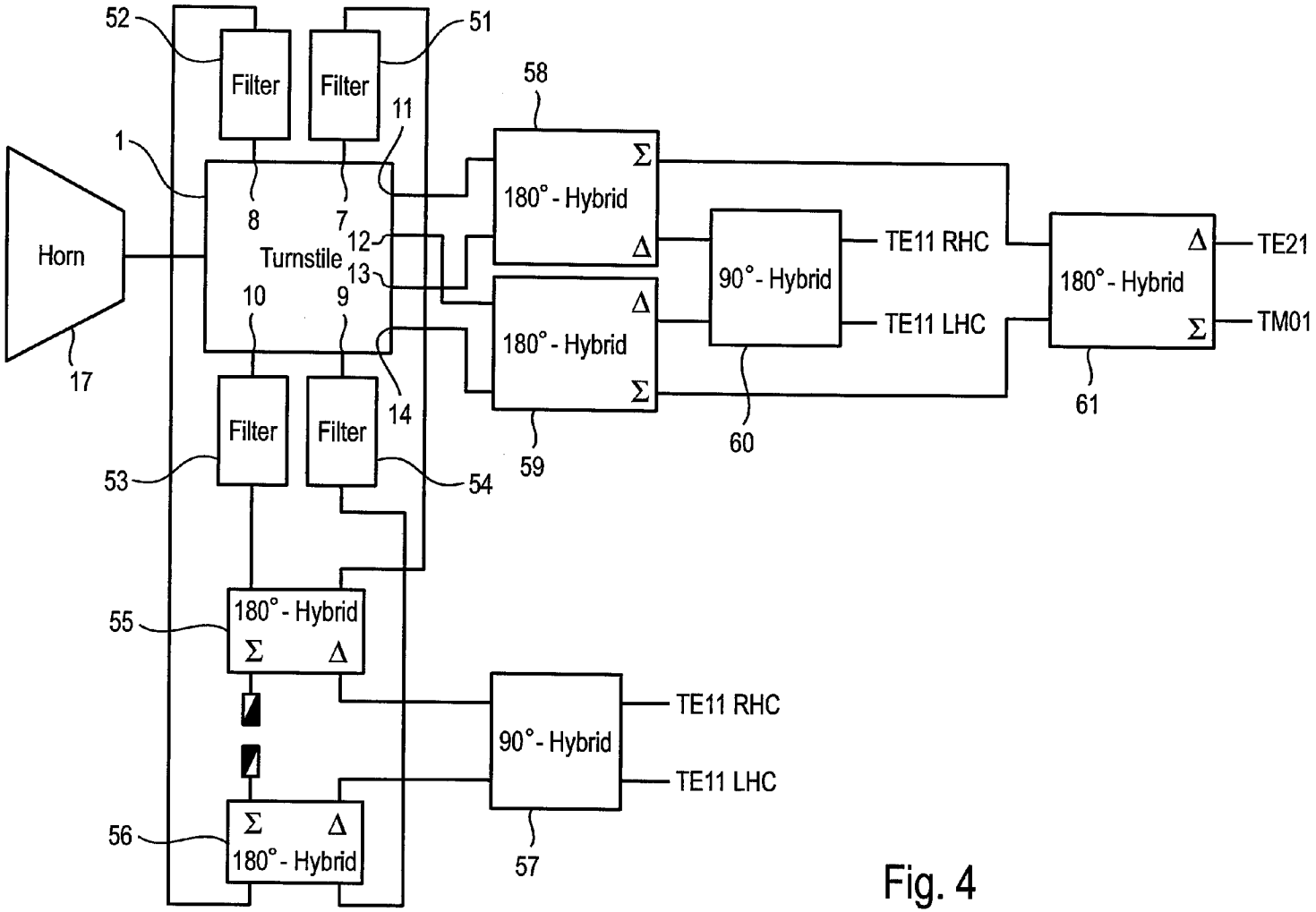
FIG. 4 is a block diagram for the use of the signal branch according to the invention in a dual-circular polarized dual-band feed system with the simultaneous decoupling of two tracking modes.

FIG. 4 shows a block diagram for the use of the turnstile branch in a dual-circular polarized dual-band feed system with the simultaneous decoupling of two tracking modes. The reference character 17 signifies the horn, which is coupled to the turnstile branch 1. The turnstile branch 1 is only shown schematically. In the block diagram, the filters 51, 52, 53, 54 connected to the transmission signal wave guides 7, 8, 9, 10 are shown. The output signal adjacent to the filters 51, 52, 53, 54 is supplied to a respective 180° hybrid coupler 55 or 56, which generates a cumulative signal and a differential signal (Σ, Δ). The differential signals (Δ) are supplied to a 90° hybrid coupler 57, which emits the signals TE11 RHC and TE11 LHC. The signals received at the receiver signal wave guides 11, 13 are supplied to an 180° hybrid coupler 58. The signals adjacent to the receiver signal wave guides 12, 14 are supplied to an 180° hybrid coupler 59. The differential signals (Δ) generated by the two hybrid couplers 58, 59 are supplied to a 90° hybrid coupler 60, which generates communications signals TE11 RHC and TE11 LHC. The cumulative signals E of the hybrid couplers 58, 59 are supplied to a 180° hybrid coupler 61, which generates a cumulative signal Σ and a differential signal Δ. The cumulative signal Σ represents the mode TM01 and the differential signal Δ represents the mode TE21.

The turnstile branch according to the invention may be used for linearly polarized signals and circularly polarized signals. FIG. 4 was drafted as an example of the use of a dual-circular polarized dual-band feed system. The feed system may be used to illuminate the reflector.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A signal branch in a reflector antenna communication system, for the transmission of microwave signals, comprising:

a common signal wave guide that transmits a transmission signal and a received signal, including a first end, a second end, an exterior and an interior;

a plurality of transmission signal wave guides that feed the transmission signal, the transmission signal wave guides being disposed on the exterior of the common signal wave guide in a symmetrically distributed manner and being communicatively connected to the common signal wave guide; and a plurality of receiver signal wave guides that transmit the received signal, the receiver signal wave guides being symmetrically adjacent to the second end of the common signal wave guide and being communicatively connected to the common signal wave guide;

wherein a cone extending in the direction of the first end is provided in the common signal wave guide on the second end.

2. The signal branch according to claim 1, wherein the common signal wave guide and the receiver signal wave guides form a receiver path that blocks a signal fed into the transmission signal wave guides and that, when the received signal is fed into the common signal wave guide, allows the propagation of a base mode with a communication signal and two higher modes with correction information for the communication signal.

3. The signal branch according to claim 2, wherein the signal branch comprises a processing unit that is designed to process the correction information and to provide two independent differential signals.

4. The signal branch according to claim 3, wherein the processing unit generates cumulative and differential signals when processing the correction information and provides the cumulative and differential signals at the same temperature.

5. The signal branch according to claim 3, wherein the processing unit is designed to provide the cumulative and differential signals only after the separation of the transmission signal from the received signal.

6. The signal branch according to claim 1, wherein, by selecting amplitudes and phases of the transmission signal fed into the transmission signal wave guides, any polarization may be set at the common signal wave guide.

7. The signal branch according to claim 1, wherein a filter is provided in each of the transmission signal wave guides.

8. The signal branch according to claim 1, wherein the received signal fed into the common signal wave guide is evenly distributed over the receiver signal wave guides.

9. The signal branch according to claim 1, wherein the common signal wave guide is embodied as a round wave guide, a rectangular wave guide, or a square wave guide.

10. The signal branch according to claim 1, wherein the transmission signal wave guides have a rectangular cross section with one long and one short side edge.

11. The signal branch according to claim 10, wherein the short side edges of each transmission signal wave guide extend parallel to an axial direction of the common signal wave guide.

12. A method for processing a received signal fed into the signal branch embodied according to claim 1, wherein the received signal is divided into a base mode having a communication signal and two higher modes having correction information for the communication signal.

13. The method according to claim 12, wherein cumulative signals and differential signals are generated by processing the correction information and these signals are provided at the same temperature.

14. The method according to claim 13, wherein the cumulative and differential signals are only provided after separation of the transmission signal from the received signal.

15. The method according to claim 12, wherein two independent differential signals are provided by processing the correction information.

16. The method according to claim 12, wherein, by selecting amplitudes and phases of the transmission signal fed into the transmission signal wave guides on the common signal wave guide, a desired polarization is set.

17. The signal branch according to claim 1, wherein the signal branch is a turnstile branch.

18. A signal branch in a reflector antenna communication system, for the transmission of microwave signals, comprising:

a common signal wave guide that transmits a transmission signal and a received signal, including a first end, a second end, an exterior and an interior;

a plurality of transmission signal wave guides that feed the transmission signal, the transmission signal wave guides being disposed on the exterior of the common signal wave guide in a symmetrically distributed manner and being communicatively connected to the common signal wave guide; and a plurality of receiver signal wave guides that transmit the received signal, the receiver signal wave guides being symmetrically adjacent to the second end of the common signal wave guide and being communicatively connected to the common signal wave guide;

wherein the receiver signal wave guides extend in the axial direction of the common signal wave guide.

19. A signal branch in a reflector antenna communication system, for the transmission of microwave signals, comprising:

a common signal wave guide that transmits a transmission signal and a received signal, including a first end, a second end, an exterior and an interior;

a plurality of transmission signal wave guides that feed the transmission signal, the transmission signal wave guides being disposed on the exterior of the common signal wave guide in a symmetrically distributed manner and being communicatively connected to the common signal wave guide; and a plurality of receiver signal wave guides that transmit the received signal, the receiver signal wave guides being symmetrically adjacent to the second end of the common signal wave guide and being communicatively connected to the common signal wave guide;

wherein dimensions of the receiver signal wave guides are determined such that no modes may be propagated in the receiver signal wave guides at transmission frequencies of the transmission signal.

20. A signal branch in a reflector antenna communication system, for the transmission of microwave signals, comprising:

a common signal wave guide that transmits a transmission signal and a received signal, including a first end, a second end, an exterior and an interior;

a plurality of transmission signal wave guides that feed the transmission signal, the transmission signal wave guides being disposed on the exterior of the common signal wave guide in a symmetrically distributed manner and being communicatively connected to the common signal wave guide; and a plurality of receiver signal wave guides that transmit the received signal, the receiver signal wave guides being symmetrically adjacent to the second end of the common signal wave guide and being communicatively connected to the common signal wave guide;

wherein the signal branch is coupled to a network made of 90° and 180° hybrid couplers that break down or recombine a mode mixture of the modes of the received signal.

21. A signal branch in a reflector antenna communication system, for the transmission of microwave signals, comprising:

a common signal wave guide that transmits a transmission signal and a received signal, including a first end, a second end, an exterior and an interior;

a plurality of transmission signal wave guides that feed the transmission signal, the transmission signal wave guides being disposed on the exterior of the common signal wave guide in a symmetrically distributed manner and being communicatively connected to the common signal wave guide; and a plurality of receiver signal wave guides that transmit the received signal, the receiver signal wave guides being symmetrically adjacent to the second end of the common signal wave guide and being communicatively connected to the common signal wave guide;

wherein the transmission signal wave guides have a rectangular cross section with one long and one short side edge; and wherein the long side edges of each transmission signal wave guide extend parallel to an axial direction of the common signal wave guide.

* * * * *